United States Patent [19]

Nichols

[11] 4,041,892

[45] Aug. 16, 1977

[54] BOOK MARKER EMPLOYING ENDLESS ELASTIC BAND

[76] Inventor: Mary V. Nichols, 220 Cherrywood Gardens, Maitland, Fla. 32751

[21] Appl. No.: 618,439

[22] Filed: Oct. 1, 1975

[51] Int. Cl.[2] ..... B42D 9/00

[52] U.S. Cl. ..... 116/119; D19/34

[58] Field of Search ..... 116/119; D19/34; 281/42

[56] References Cited

U.S. PATENT DOCUMENTS

| | | | |
|---|---|---|---|
| 139,936 | 6/1873 | Ward | 116/119 |
| 480,649 | 8/1892 | Bailey | 116/119 |
| 3,020,876 | 2/1962 | Riden | 116/119 |
| 3,898,951 | 8/1975 | Clare | 116/119 |
| D. 66,322 | 12/1924 | Crane | D19/34 |

*Primary Examiner*—S. Clement Swisher
*Assistant Examiner*—Denis E. Corr
*Attorney, Agent, or Firm*—Duckworth, Hobby, Orman, Allen & Pettis

[57] ABSTRACT

A book marker for books of the type having front and back covers includes an endless elastic band for encircling one of the covers and at least one marking strip joined to the elastic band for marking preselected pages of the book between the covers.

5 Claims, 2 Drawing Figures

BOOK MARKER EMPLOYING ENDLESS ELASTIC BAND

BACKGROUND OF THE INVENTION

1. Field of the Invention

The present invention relates to book markers, and in particular to a book marker which is capable of being easily manufactured.

2. Description of the Prior Art

A variety of book marker arrangements are known in the prior art. For example, in U.S. Pat. No. 1,809,943, Ockenden discloses a book marker employing a single length of elastic material having a metallic clip fastened on either end thereof. The metallic clip utilizes a gripping member at either end thereof. The gripping member employs a flat hook at the extremity thereof which is adapted to hook about the outer cover of the book. The hook also includes an aperture through which is threaded a string or similar material to be used as a page marker.

A somewhat similar arrangement is disclosed by Greider in U.S. Pat. No. 2,911,940. According to Greider, a metallic clip having a tensioned portion is slipped over the top of the book cover, and includes a marker strip which is adapted to slip between pages of the book for marking purposes. Other book marking arrangements are disclosed in the following U.S. Pat. Nos.: 759,427 to Fairchild; 480,649 to Bailey et al; 2,716,390 to Goins; 865,092 to Erickson; and 3,020,876 to Riden. Other prior art patents of interest may also be found in United States Patent and Trademark Office class 116, subclass 119; and design class 97, subclass 2.

The book marker arrangements disclosed in the prior art are relatively complex and costly to manufacture.

SUMMARY OF THE INVENTION

The present invention contemplates a book marker for books of the type having front and back covers, the book marker comprising an endless elastic band for encircling one of the front and back covers and at least one marking strip joined to the elastic band for marking preselected pages of a book between the front and back covers.

In a preferred embodiment, the marking strips are joined tangent to the elastic band either at the stitch between the extremities of the elastic band, or alternatively by a single stitch with a decorative stitch covering.

THE DRAWINGS

DETAILED DESCRIPTION

A book marker in accordance with the present invention will be described with reference to FIGS. 1 and 2.

Figure 1:
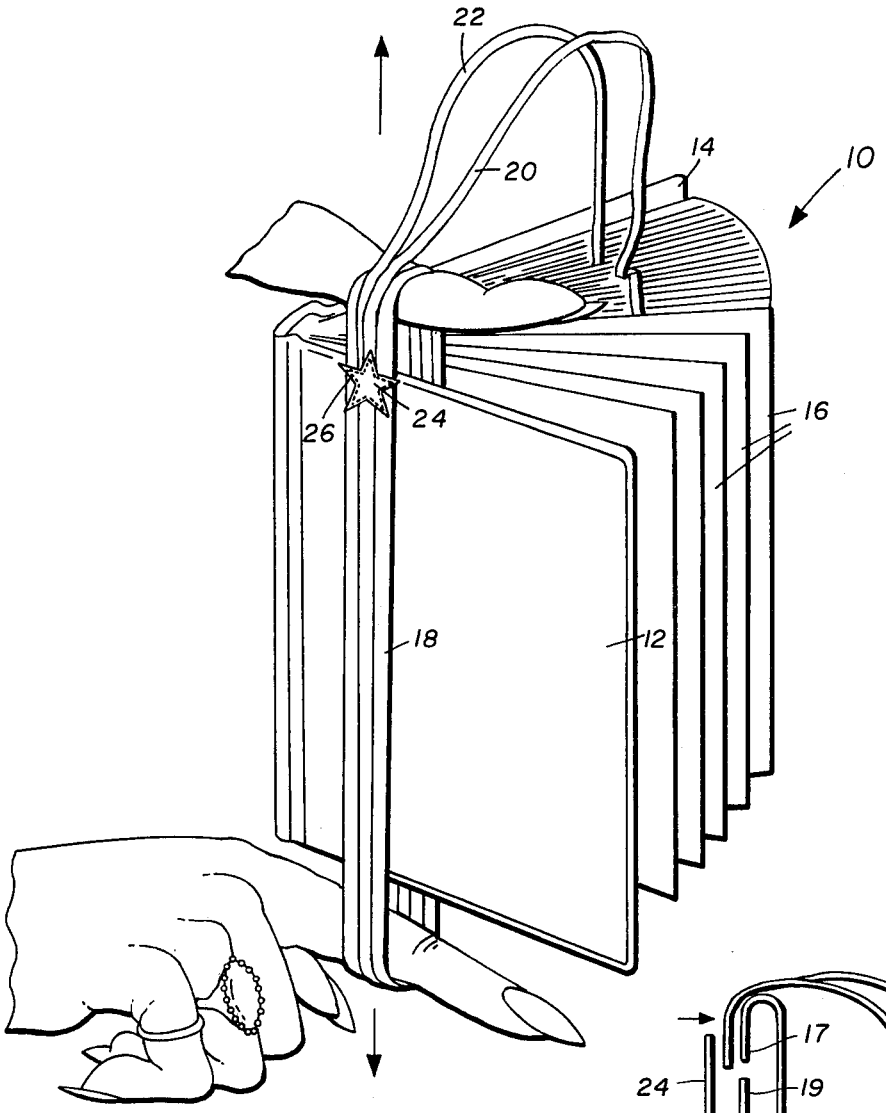
FIG. 1 illustrates a perspective view of a book employing a book marker in accordance with the present invention.

Noting FIG. 1, the book marker and book combination, referred to generally as 10, includes a book having front and back covers 12 and 14 respectively, and intermediate pages 16 between the covers.

A book marker in accordance with the present invention includes an elastic band 18 and two marking strips 20 and 22 joined to the elastic band for marking preselected pages 16 of the book between the front and back covers 12 and 14. The marking strips 20 and 22 are joined tangent to the elastic band 18 (note FIG. 2). A decorative FIG. 24, such as the star depicted in FIG. 1, overlays the point at which the marking strips 20 and 22 are joined to the elastic band, to cover the stitching at that juncture.

Figure 2:
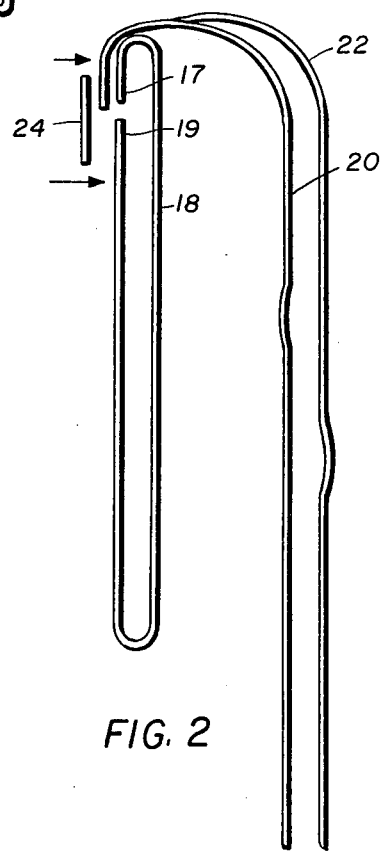
FIG. 2 is an exploded side view of a book marker in accordance with the present invention.

With specific reference to FIG. 2, it will be seen that the book marker may be formed in one of two ways. First, the elastic strip 18, having two ends 17 and 19 may be formed in an endless band by stitching the two ends 17, 19 together. The marking strips 20, 22 may be simultaneously stitched to the elastic band 18 during the process of stitching the two ends 17, 19 together. The stitch pad 26 may then be stitched over the intersection point between the marking strips 20, 22 in the elastic band 18.

Alternatively, the two ends 17, 19 of the elastic band 18 may be joined together, and the marking strips 20, 22 then placed over the stitched ends 17, 19. Thereafter, a single stitching 26 (note FIG. 1) may be made about the periphery of the stitch pad 24 in order to join both the stitch pad and the marking strips 20, 22 to the elastic band 18.

In use, the reader stretches the elastic band 18 in the manner shown in FIG. 1, and inserts either the front or back cover 12, 14 through the loop defined by the endless elastic band 18. Thereafter, the elastic band is simply allowed to contract about the respective cover, and the marking strips 20, 22 are utilized to mark respective pages of the book. An important feature of the book marker in accordance with the present invention is the ability to rotate the endless band 18 about the respective front or back cover 12, 14 to which it is joined. This allows the marking strips to be shortened with respect to the book, thus preventing any unnecessary amounts of the marking strips 20, 22 from extending below the bottom of the book. It will thus be understood that this capability of rotating the elastic band 18 and the elasticity in the band itself allows the book marker of the present invention to be adapted to books of a wide variety of dimensions.

I claim:

1. A book marker for books of the type having front and back covers comprising:

an endless elastic band for encircling one of said front and back covers;

at least two marking strips stitched tangent to said elastic band at a point along said band for marking preselected pages of a book between said front and back covers;

a stitch pad sewn over both said marking strips at said point; and means for changing the length of said marking strips, said length changing means comprising means for rotating said band around said cover.

2. The book marker as recited in claim 1 wherein said elastic band comprises an elastic strip having two ends with stitching joining said two ends.

3. The book marker as recited in claim 2 further comprising said marking strip joined to said elastic band by said stitching.

4. The book marker recited in claim 1 wherein said stitch pad and said marking strip are joined to said elastic band by a single stitching.

5. The book marker recited in claim 1 wherein said band is substantially wider than said marking strips.

* * * * *